US006444116B1

(12) United States Patent
Galiasso et al.

(10) Patent No.: US 6,444,116 B1
(45) Date of Patent: Sep. 3, 2002

(54) PROCESS SCHEME FOR SEQUENTIALLY HYDROTREATING-HYDROCRACKING DIESEL AND VACUUM GAS OIL

(75) Inventors: Roberto Galiasso, Miranda; Edilberto Rodriguez, Edo Miranda, both of (VE)

(73) Assignee: Intevep, S.A., Caracas (VE)

( * ) Notice: Subject to any disclaimer, the term of this patent is extended or adjusted under 35 U.S.C. 154(b) by 98 days.

(21) Appl. No.: 09/685,810

(22) Filed: Oct. 10, 2000

(51) Int. Cl.[7] ..... C10G 65/02; C10G 65/10; C10G 65/12

(52) U.S. Cl. ..... 208/58; 208/59; 208/61; 208/311; 208/339; 208/341

(58) Field of Search ..... 208/58, 59, 61, 208/311, 339, 341

(56) References Cited

U.S. PATENT DOCUMENTS 3,365,388 A * 1/1968 Scott, Jr. ..... 208/110
3,607,734 A * 9/1971 Stafford, Sr. ..... 208/341
3,733,260 A 5/1973 Davis et al.
3,806,444 A * 4/1974 Crouch et al. ..... 208/210
4,010,010 A * 3/1977 Ward ..... 208/343
4,414,103 A 11/1983 Farrell
4,422,927 A * 12/1983 Kowalczyk et al. ..... 208/211
4,822,480 A 4/1989 Harandi et al.
4,954,241 A 9/1990 Kukes et al.
5,110,444 A 5/1992 Haun et al.
5,110,562 A 5/1992 Haun et al.
5,447,621 A 9/1995 Hunter
6,106,694 A * 8/2000 Kalnes et al. ..... 208/57
6,190,535 B1 * 2/2001 Kalnes et al. ..... 208/107
6,296,758 B1 * 10/2001 Kalnes et al. ..... 208/103

* cited by examiner

*Primary Examiner*—Walter D. Griffin
(74) *Attorney, Agent, or Firm*—Bachman & LaPointe, P.C.

(57) ABSTRACT

An integrated process for treating a vacuum gas oil, kerosene, naphtha and Diesel-containing feed, includes the steps of providing a reaction feed containing residue, vacuum gas oil, kerosene, naphtha, Diesel, hydrogen sulfide, ammonia, and $C_1$–$C_4$ gas phase compounds; providing a stripping gas; providing a washing feed; and feeding the reaction feed, the stripping gas and the washing feed to a stripping and washing zone so as to obtain a gas phase containing the hydrogen sulfide, the ammonia, the $C_1$–$C_4$ gas phase compounds, the naphtha, the kerosene, the Diesel and the vacuum gas oil and a liquid phase, wherein the reaction feed is provided at a reaction feed pressure of between bout 700 psig and about 3500 psig, and wherein the stripping and washing zone is operated at a pressure within about 80 psig of the reaction feed pressure.

27 Claims, 6 Drawing Sheets

PROCESS SCHEME FOR SEQUENTIALLY HYDROTREATING-HYDROCRACKING DIESEL AND VACUUM GAS OIL

BACKGROUND OF THE INVENTION

The invention relates to hydrotreating and hydrocracking vacuum gas oil, Diesel, kerosene and naphtha fractions obtained from a vacuum residue hydrocracking (VRHCK,) using a high temperature and high pressure stripping and washing stage for connecting two high pressure reaction zones. More particularly, the invention relates to a hydrotreating and/or hydrocracking process using a high pressure, high temperature stripping and washing process which is well suited as an intermediate step integrated into a high temperature and high pressure loop of a vacuum residue hydrocracking (VRHCK) process wherein the VRHCK process and stripping-washing step produce kerosene, naphtha, Diesel and vacuum gas oil feeds to a hydrotreating-hydrocracking reactor for reducing sulfur content and improving naphtha, kerosene and Diesel yields and quality; in particular to produce a high smoke point kerosene, high cetane number and low sulfur Diesel and a low sulfur naphtha fractions.

Many refineries hydrotreat virgin and cracked feedstocks in order to obtain upgraded gasoline and Diesel products. These refineries utilize high-pressure units. High pressure hydrodesulfurization (HDS) units can be utilized with cracked vacuum gas oil (VGO), and when operated between 700–1200 psig, can achieve HDS conversion rates of greater than 99% so as provide a product having a sulfur content between 0.002 and 0.12% wt. This product can then be fed to a fluid catalytic cracking (FCC) process to produce gasoline and Diesel fuel with sulfur content less than 150 ppm and 600 ppm respectively. Unfortunately, the Diesel fraction produced in an FCC process from such a VGO feed typically has a cetane number of only about 20–30, which is considered "out of spec" and prevents this product from being incorporated into the Diesel pools. In order to be used, this Diesel fraction must be treated with additional hydrotreating steps. In addition, numerous other Diesel streams are readily available in the refineries such as straight run kerosene and Diesel, thermal cracked Diesel and the like, all of which have high sulfur content and typically medium cetane number that will require an additional deep hydrotreatment.

Conventional low-medium pressure Diesel hydrotreatment can satisfactorily reduce the sulfur content, but provides only small improvements in cetane number, in the range of 2–4 point increments.

Some refineries have installed residue hydrocracking units to convert the heaviest part of the oil into distillates. All of these technologies produce a medium quality product that requires an additional high pressure hydrotreating stage in a separate unit to fulfill the pool specifications. They also produce a large amount of VGO that needs to be converted in standard fluid catalytic cracking or hydrocracking units.

Typical catalysts for use in hydrotreating-hydrocracking processes to increase cetane number and smoke point and to reduce sulfur to very low level are extremely sensitive to even small amounts of sulfur and ammonia, and therefore cannot readily be incorporated into hydrotreating-hydrocracking reactors.

Alternatives for processing all the naphtha, kerosene, Diesel and VGO to solve the yield and quality problem identified above include integrating a high pressure hydrotreating and hydrocracking reactor into an existing or new vacuum residue hydrocracking technology for sequentially hydroprocessing-hydrocracking the available "out of spec" products. That effort attempts to address the yield, sulfur, smoke point and cetane number objectives by using two or more stages of hydroprocessing. Unfortunately, conventional vacuum residue hydrocracking units require a conventional separation process where the products are cooled and depressurized to be able to separate and then treat those products in a stand alone hydrotreating or hydrocracking or FCC unit. These conventional separation processes are carried out at low temperature, low pressure, or both, resulting in the need for additional compression systems, one for each stage, which can double equipment and operation costs. Even then, a complete and potentially very expensive hydrotreating-hydrocracking-FCC unit is required.

It is clear that the need remains for a method for treating feedstocks such as vacuum gas oil, kerosene, Diesel and naphtha, "out of spec" product from primary conversion (VRHCK), and others such as Diesel and naphtha fractions available in the refinery, so as to advantageously improve yields and reduce sulfur content while improving smoke point and cetane number. Further, the need remains for a process whereby separation of components is achieved at high temperature and pressure so as to avoid the need for additional compression equipment and the like. Still further, the need remains for a process to hydrofinish the product without the need to buy additional complete hydrotreating-hydrocracking units.

It is therefore the primary object of the present invention to provide a process whereby VGO, kerosene, Diesel, and naphtha "out of spec" feedstocks can advantageously and economically be converted into valuable end products.

It is another object of the invention to provide a process which can advantageously find use in revamping existing facilities or building new ones.

It is a further object of the invention to provide a process for high pressure and high temperature separation to produce an intermediate feedstock that can be blended with an external VGO, Diesel and naphtha "out of spec" component to be sequentially hydrotreated or hydrocracked in subsequent hydrotreating-hydrocracking reaction stages.

It is still another object of the present invention to utilize the existing high pressure and temperature loop in a vacuum residue hydrocracking unit or process to provide an integrated process which sequentially integrates a hot separation-stripping washing system into a vacuum residue hydrocracking process with a further hydrotreating-hydrocracking stage or stages so as to advantageously and efficiently provide for excellent conversion rates in converting the VGO, kerosene, Diesel and naphtha feeds to desirable end product, while nevertheless minimizing expense due to equipment costs and efficiently utilizing high pressure and temperature conditions.

Other objects and advantages will appear herein below.

SUMMARY OF THE INVENTION

In accordance with the present invention, the foregoing objects and advantages have been readily attained.

According to the invention, a process is provided for sequentially hydrotreating vacuum gas oil, kerosene, Diesel and naphtha, which process comprises the steps of providing a reaction feed containing residue, vacuum gas oil, kerosene, naphtha, Diesel, hydrogen sulfide, ammonia, and $C_1$–$C_4$ gas phase compounds; providing a stripping gas; providing a washing feed; and feeding said reaction feed, said stripping gas and said washing feed to a stripping and washing zone so as to obtain a gas phase containing said hydrogen sulfide, said ammonia, said $C_1$–$C_4$ gas phase compounds, said naphtha, said kerosene, said Diesel and said vacuum gas oil and a liquid phase, wherein said reaction feed is provided at a reaction feed pressure of between about 700 psig and about 3500 psig, and wherein said stripping and washing zone is operated at a pressure within about 80 psig of said reaction feed pressure. The hydrotreating-hydrocracking reactors, as well as the stripping/washing separator, are advantageously operated at substantially the same pressure, and preferably substantially the same temperature, thereby avoiding the need for additional compressor equipment between stages and limiting the need for additional heating between stages as well, while utilizing the already established temperature and pressure from the VRHCK loop to carry out further improvement as desired.

The inventive separation-reaction process can advantageously be used to integrate hydrotreatment-hydrocracking processes which occur at high temperatures and pressures so as to sequentially treat vacuum gas oil, kerosene, Diesel, naphtha and other feeds to obtain high conversion to desirable products at reduced cost.

BRIEF DESCRIPTION OF THE DRAWINGS

A detailed description of preferred embodiments of the present invention follows, with reference to the attached drawings, wherein.

DETAILED DESCRIPTION

Figure 1:
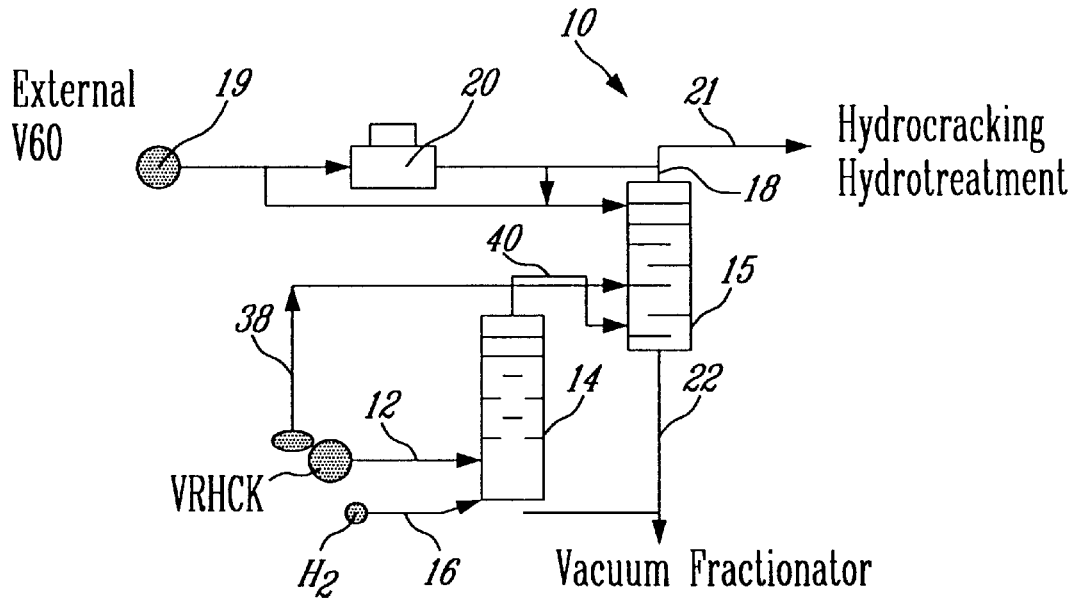
FIG. 1 schematically illustrates a system and process in accordance with the present invention.

The invention relates to a process for sequentially treating vacuum gas oil, kerosene, Diesel and naphtha so as to provide a final product fraction including components having satisfactorily low sulfur content, kerosene and/or jet fuel fraction with high smoke point and Diesel fractions having cetane numbers sufficiently improved to allow incorporation into the Diesel pools. The process utilizes a stripping and washing step (HSSW) to accomplish a high temperature and high pressure separation of an intermediate feedstock for example from a vacuum residue hydrocracking process, so as to avoid the need for intermediate compression and/or reheating of the separated phases and thereby allow direct feed to subsequent hydrotreating-hydrocracking stages and the like which utilize the high pressure and temperature.

The invention further relates to an integrated processing method which integrates a hydrotreating-hydrocracking stage or system into a vacuum residue hydrocracking process having a high-pressure and high-temperature circuit and utilizing the aforesaid stripping and washing step between stages.

As will be further discussed below, the process of the present invention advantageously maintains the pressure of the product of the initial hydrotreating or hydrocracking step through separation of that product into portions, and through feed of some portions into a subsequent step such as a hydrotreating-hydrocracking step so as to provide the desired hydrotreating-hydrocracking conditions and reactions without the need for multiple compressors and the like, and to provide more efficient energy utilization. Conventionally, the intermediate feed, for example from a VGO reactor product, is cooled and the pressure reduced, to provide a separate hydrogen rich phase and a hydrocarbon rich phase. This creates the need for additional compressors and/or heating equipment to re-pressurize and re-heat at least some portions of the intermediate feed.

One process in which a hot separation-stripping and washing (HSSW) step according to the present invention is particularly advantageous is a process for sequentially treating a combined vacuum gas oil (VGO), kerosene, Diesel and naphtha feedstock. In such a process, the initial feed composed of hydrogen and vacuum residue is hydrocracked into a reaction feed containing VGO, Diesel, naphtha, $C_1$–$C_4$, hydrogen sulfide, ammonia and hydrogen. This reaction feed is preferably treated under high pressure and high temperature conditions utilizing a hot separation-stripping and washing (HSSW) zone as discussed further below, so as to obtain a gas phase which can advantageously be passed to a hydrotreatment-hydrocracking zone and a liquid phase which may suitably be treated through distillation to recover vacuum gas oil to be recycled to the process and a bottom that is ideal for feed to delayed coking processes or the like. The following description will be given in terms of this type of process. It should readily be appreciated, however, that the intermediate hot separation, stripping and washing steps and process of the present invention would be readily applicable to other types of processes as well and can be varied without departing from the scope of the present invention.

Typical feed for the overall process of this embodiment includes vacuum residue and various distillate products, one suitable example of which is vacuum gas oil (VGO), Diesel (DO) and naphtha (N). VGO streams are readily available in refineries but frequently have unacceptably high sulfur content. These streams do include portions which can advantageously be converted into useful gasoline, jet fuel and Diesel fractions in a stand alone hydrocracker, but at great expense. The VGO can also be treated in a Fluid Catalytic Cracking process but, unfortunately, the Diesel fraction produced typically has a cetane number which is too low to be useful without further treatment.

Additional feedstocks which can find advantageous use in the overall process of the present invention include other refinery streams including kerosene, Diesel and naphtha streams such as straight run kerosene and Diesel, thermal cracked Diesel and naphtha (for example from a delayed coker) and the like, each of which typically has high sulfur content, and Diesel having a medium cetane number which will require improvement in order to be added to the Diesel pool.

In accordance with the process of the present invention, a first hydrocracking reaction zone is established, for advantageously converting the vacuum residue into a product stream containing residue, VGO, kerosene, Diesel, naphtha, $C_1$–$C_4$ gas phase compounds, hydrogen sulfide, and ammonia. Product fractions from the hydrocracking are used as reaction feed to a high pressure separation-stripping-washing (HSSW) zone operating at substantially the same pressure as the outlet from the hydrocracking step. The hot separation-stripping and washing step advantageously produces a gas phase advantageously containing hydrogen, naphtha, kerosene, Diesel, light and heavy vacuum gas oil, $C_1$–$C_4$ containing compounds, $H_2S$ and $NH_3$ fractions, and a liquid phase including small amounts of Diesel and light vacuum gas oil, heavy vacuum gas oil and residue. The gas phase is advantageously still at a pressure and temperature which is sufficiently high that the gas phase can be fed directly to a second high pressure reaction zone, for example hydrotreating-hydrocracking, to convert the vacuum gas oil into high quality distillates and improve the quality of the Diesel, kerosene and naphtha, without the need for additional compressors or heaters and the like.

Thus, the stripping and washing step of the present invention provides the desired liquid and gas phases without substantially changing the pressure between the hydrocracking and subsequent hydrotreating-hydrocracking steps. The pressure at the hydrocracking or first stage, the separating stage and the hydrotreating-hydrocracking or second stage may advantageously be between about 900 psig and about 3500 psig, more preferably between bout 1300 psig and about 3000 psig. The pressure is preferably between about 900 psig and about 3000 psig at the outlet of the vacuum residue hydrocracking stage, and is maintained within about 80 psig, more preferably about 50 psig, of the pressure of the second hydrotreating-hydrocracking stage reaction inlet through the hot separation stripping and washing zone.

As set forth above, the feed to the hydrocracking reactor is preferably a vacuum residue oil feed that is to be converted to more valuable distillates products. The vacuum residue feed may be heated before entering the hydrocracking reactor, preferably to a temperature of between about 400° F. and about 800° F., and more preferably between about 500° F. and about 650° F. The vacuum residue may be blended with hydrogen and catalyst and fed to the hydrocracking reactor. The hydrocracking reactor may suitably be an up flow bubble type reactor or other suitable reactor, and the catalyst used may be any iron based or coke based catalyst having activity toward the desired reaction.

The product of the hydrocracking reactor typically includes hydrogen, naphtha, kerosene, Diesel, LVGO, HVGO, $C_1$–$C_4$ hydrocarbons, hydrogen sulfide and ammonia and where the Diesel, kerosene and naphtha fractions are frequently "out of spec", or have inappropriate characteristics for final blending in the refinery pool.

As used herein, the term "out of spec" refers to a hydrocarbon product or composition having characteristics which do not meet standards set for use of such a composition as a fuel.

This product stream, or at least a portion of the stream, is fed alone or combined with external VGO, Diesel, and/or naphtha, as a reaction feed to the high temperature and high pressure hot separation-stripping-washing zone for separation into phases as desired in accordance with the invention. An embodiment of a high pressure hot separation-stripping washing zone is illustrated in FIG. 1, which will be further discussed below.

FIG. 1 shows a hot separation-stripping-washing zone 10, wherein the reaction feed 12 from the hydrocracking reactor is preferably introduced into a stripping and washing (HSSW) vessel or vessels 14, 15 along with a stripping gas 16 such as hydrogen and a washing feed or medium 18 such as additional external feed of Diesel, LVGO and the like. A portion of washing feed in FIG. 1 is shown passing from an external VGO source 19 through a furnace 20 and then being blended with a gas phase from vessel 15, while another portion is fed to vessel 15. Ideally, the reaction feed, washing feed and stripping gas are fed to the reactor or vessel each at different vertical heights, and the HSSW vessels 14, 15 have a gas phase outlet 21 and a liquid phase outlet 22.

The stripping gas serves to enhance high temperature and high pressure separation of hydrogen, hydrogen sulfide, ammonia, $C_1$–$C_4$ and naphtha compounds into the gas phase. The hydrogen stripping also serves to enhance separation of the gas phase, and is itself present in the gas phase which is produced and which is useful as a feed to later hydrotreatment processes. In the vacuum residue hydrocracking (VRHCK) example of the present embodiment, the gas phase product of the stripping and washing step preferably includes hydrogen, naphtha, kerosene, Diesel, LVGO, $C_{1-C4}$ hydrocarbons, $H_2S$ and $NH_3$. The remaining liquid phase from the stripping and washing step mainly includes solid catalyst from the VRHCK process, HVGO and unconverted residue.

The liquid phase can advantageously be fed to further fractionation to recover VGO, which can be recycled, and catalyst plus unconverted residue that can be further processed, for example in a delayed coking process or the like. In the VRHCK embodiment of the present invention, this liquid phase may typically include a small amount of Diesel and LVGO, as well as HVGO and vacuum residue. A significant benefit provided by the present invention is that the washing step controls and/or avoids asphaltene and catalyst carry over into the gas phase which is beneficial for allowing further trickle bed processing.

It should readily be appreciated that the hot separation-stripping and washing steps of the present invention provide for advantageous separating of the gas and liquid phases, and the components present in each, without cooling and de-pressurization of the reaction feed which therefore does not require re-pressurization in order to be treated in subsequent high-pressure reactions.

It should also be noted that the use of externally obtained feed as washing and/or stripping feed allows for the adjustment or fine-tuning of temperature in the stripping and washing (HSSW) vessel, if desired. This is accomplished by feeding the external feed and/or stripping gas in greater or lesser amounts, and/or at different temperatures, so as to provide a desired resulting temperature of the combined mixture.

The stripping gas may suitably be hydrogen which is well suited for the desired stripping function and which can readily be recycled from the gas phase product of the stripping and washing step. Of course, other sources of hydrogen or other stripping gas could be used if desired.

The washing feed may suitably be Diesel, hydrotreated naphtha, LVGO or any other suitable washing substance, which could advantageously be provided from storage, from VGO liquid fractions separation (VGO), or from other treatment units such as DC, FCC, distillation, low pressure HDS units and other units or processes. In this regard, any of these sources could be regarded as external feed sources.

In accordance with the invention, the reaction feed, stripping gas and washing feed are preferably each fed to the stripping and washing zone in amounts sufficient to provide the desired separation of gas and liquid phases. Stripping gas may suitably be fed to the stripping and washing zone in an amount between about 10 and about 100 $ft^3$ of gas per barrel of reaction feed. Washing feed may advantageously be fed in an amount between about 5% v/v and about 25% v/v with respect to the reaction feed.

It is particularly advantageous that the gas phase produced from the separating and washing step is produced at a pressure which is within about 80 psig and more preferably is within about 50 psig of the pressure of the upstream or VR hydrocracking reaction zone, and is further therefore still at a pressure sufficiently elevated that desirable second reactions such as hydrotreatment-hydrocracking and the like can be carried out without needing to feed the gas phase to a compressor.

In accordance with the hydrocracking/hydrotreating-hydrocracking embodiment of the present invention, the gas phase from the hot separator-stripper-washing zone is fed to a second reactor for carrying out hydrotreating-hydrocracking so as to improve the distillate fraction yields and quality. The product of the hydrotreating-hydrocracking reaction step includes a kerosene or jet fuel having a smoke point between 20 and 28, which is substantially increased, by between 5 to 8 numbers in comparison with the first reaction stage product, a Diesel fraction having a cetane number between 45 and 60, which is substantially increased, by at least about 13 numbers in comparison with first reaction stage or imported fraction, and jet fuel and Diesel with a sulfur content less than or equal to about 20 ppm. The gasoline fraction is provided having a sulfur content of less than or equal to about 5 ppm.

Additional liquid product fractions from the separation-stripping-washing zone can advantageously be fractionated to recover VGO for further recycling and processing, and the liquid phase contains remaining catalyst and vacuum residue which advantageously allows the second reaction zone to be a trickle bed hydrogenating-hydrocracking reactor preferably containing effective amounts of a suitable catalyst, preferably a sulfur-nitrogen resistant catalyst selective toward aromatic saturation and alkylparaffin forming reactions. Of course, the second reaction may be any desirable high pressure reaction, and the catalyst should be selected having activity toward the desired reaction.

Figure 2:
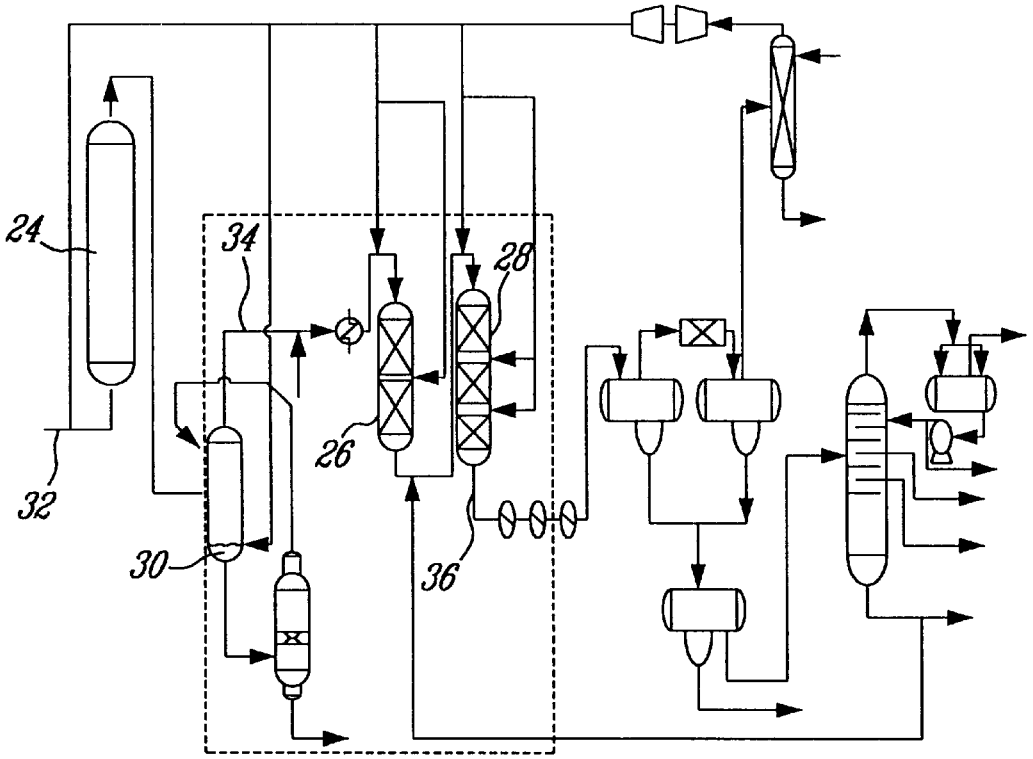
FIG. 2 further illustrates the integration of FIG. 1 in a vacuum residue hydrocracking unit.

Turning now to FIG. 2, a process in accordance with the present invention is schematically illustrated. FIG. 2 shows a first reactor system 24 for carrying out an initial hydrocracking reaction, second and third reactors 26 and 28 for carrying out a hydrotreating-hydrocracking reaction, and a high-pressure hot separation-stripping-washing unit 30 connected between reactor 24 and reactors 26, 28 for advantageously separating the product of reactor 24 into a high pressure gas phase for treatment in reactors 26, 28 according to the invention, and a liquid phase for further fractionation and VGO recycle.

As shown, the process advantageously begins through providing a vacuum residue feed 32 which can be fed to a heater if desired and which is then fed to first reactor 24. The converted products from first reactor 24 are conveyed through various stages and then as feed to an inlet to hot separation-stripping-washing unit (HSSW) 30, along with additional VGO and Diesel from an external source, hydrotreated naphtha and a feed of hydrogen as stripping gas. This combination of components forms the feed blend to unit 30. Unit 30 produces a gas phase 34 containing, ideally, hydrogen, naphtha and Diesel fractions as well as LVGO, $C_1$–$C_4$ hydrocarbons, $H_2S$ and $NH_3$. The gas phase 34, or a portion thereof, is then fed directly to second and third reactors 26, 28 where VGO, kerosene, Diesel and naphtha fractions are subjected to hydrotreating-hydrocracking so as to increase the distillate yields and quality such us smoke point, cetane number and sulfur as desired. Product 36 from second and third reactors 20, 21 can then be separated into gasoline, jet fuel, Diesel, unconverted VGO that is recycled, and other fractions.

A portion of unconverted vacuum residue may be separated off as fuel for heater(s), if desired, so as to provide for desired heating of the vacuum residue feed. Of course, other heating mechanisms and methods could also be used.

In addition, hydrogen is in this embodiment separated from the gas phase of product of second-third reactors 26, 28, preferably downstream of reactors 26, 28, and is purged and recycled for mixing with vacuum residue to form the 00-152 feed blend for the hydrocracking reactor system 24, and could also be recycled as stripping gas.

The $H_2S$ and the $NH_3$ portions of gas phase 34 can be separated prior to feed to reactors 26, 28, if desired.

A particular advantage of the present invention is that hydrocracking reactor system 24 (R1), hydrotreating-hydrocracking reactors 26, 28 (R2, R3) and stripping/washing unit 30 are all operated at substantially the same pressure such that no additional compressor equipment is required along the process stream from first reactor system 24 through unit 30 to second and third reactors 26, 28. Thus, equipment and other overhead costs in connection with the process of the present invention are significantly reduced while end products are advantageously low in sulfur content while nevertheless including jet fuel and Diesel fractions possessing increased smoke point and cetane number respectively.

Referring now back to FIG. 1, the hot separation-stripping-washing steps of the present invention are further discussed. Input to these steps includes external Diesel or VGO mixture as a washing feed, a converted Diesel fraction 12 from a first reactor (VRHCK) as a reaction feed, a liquid hydrotreated naphtha phase 38 and makeup hydrogen 16 as stripping gas. Also as shown and discussed above, HSSW zone 10 may have two zones 14, 15, and the gas phase 40 from zone 32 may be fed to zone 15 with gas phase 21 serving as feed to a hydrotreatment-hydrocracking or other process such as reactors of FIG. 2 or the like. The product stream from HSSW zone 10 also includes a liquid phase 22 containing stripped VGO, vacuum residue and catalyst, as well as other liquid products which are preferably conveyed to a fractionator or vacuum distillation to recover VGO and other distillable products. The unconverted vacuum residue plus catalyst is ideal for processing at a delayed coker and the like.

The operating conditions for the hydrocracking (VRHCK) reactor system and subsequent hydrotreating-hydrocracking reactors are advantageously selected so as to maintain and utilize the pressure from the first reactor system (VRHCK) in the subsequent reactors and thereby enhance efficiency and avoid the need for additional compressor equipment therebetween. The process operating conditions for the initial reactor may be selected based upon the characteristics of the feed, for example, and these operating conditions can then be determinative of the operating conditions in the subsequent reactors. Table 1 set forth below provides examples of typical operating conditions for a VRHCK reactor (R1) and subsequent hydrotreatment reactors (R2) and (R3) for start of run (SOR) and end of run (EOR).

TABLE 1

| | R1 | | R2–R3 | |
|---|---|---|---|---|
| Condition | SOR | EOR | SOR | EOR |
| Pressure psig inlet-outlet | 3000/2900 | 3000/2900 | 2850/2800 | 2850/2750 |
| LHSV h-1 | 1–0.7 | 1–0.7 | 0.75–1.5 | 0.75–1.5 |
| Temperature o range | 400–450 | 400–450 | 380–350 | 360–380 |
| Beds with Quench | 2–3 | 2–3 | 2–3 | 2–3 |
| H2 partial pres. Psig | 2000–2400 | 2000–2400 | 1700–2000 | 1650–1950 |

An example of typical feed for the Hydrocracking reactor system for the process of the present invention is set forth in the last column below in Table 2. An example of typical feeds to hydrotreating and hydrocracking reactors are set forth in Table 2 columns 2 to 6.

TABLE 2

| | Component of the Feed to R2/R3-- | | | | | Feed R1 |
|---|---|---|---|---|---|---|
| | HCN | HCGO | AGO | LVGO | HVGO | VR |
| API GRAVITY | 52.4 | 20.8 | 23 | 20.2 | 16.5 | 3 |
| NITROGEN, wppm | 280 | 4433 | 541 | 846 | 1513 | 0.4 |
| SULFUR, wt % | 1.23 | 3.80 | 2.00 | 2.30 | 2.70 | 4.3 |
| CONRADSON CARBON, wt % | — | 0.14 | 0.01 | 0.13 | 0.52 | 23 |
| DISTILL-ATION | TBP | TBP | TBP | TBP | TBP | TBP |
| IBP | 163 | 623 | 570 | 418 | 588 | 530 |
| 5 | 182 | 634 | 680 | 495 | 702 | 570 |
| 10 | 200 | 644 | 705 | 527 | 748 | 630 |
| 30 | 247 | 688 | 746 | 608 | 829 | |
| 50 | 289 | 744 | 775 | 671 | 883 | |
| 70 | 328 | 809 | 815 | 733 | 938 | |
| 90 | 363 | 887 | 885 | 816 | 1011 | |
| 95 | 380 | 911 | 927 | 859 | 1046 | |
| FBP | 397 | 937 | 962 | 928 | 1067 | |

As set forth above, the feed to the VRHCK reactor system preferably includes a vacuum residue, and feed to the hydrotreating-hydrocracking reactors may typically include a blend of VGO, Diesel and other components. Table 3 below sets forth characteristics of a typical VGO feed blend, and Diesel blend for the hydrotreating-hydrocracking reactors (R2–R3) in accordance with the present invention. The R2 and R3 feedstock could be composed of different proportions of product coming from first reactor R1 and from external sources of components. To provide a specific example, Table 3 groups the VGO, Diesel and kerosene fractions.

TABLE 3

| Reactor stages | R2/R3 | R2/R3 | R2/R3 |
|---|---|---|---|
| INLET | VGO blend | Diesel blend | Kerosene |
| API GRAVITY | 16–22 | 28–33 | 27–34 |
| SULFUR, wt % | 1.0–3 | 0.02–2 | 0.01–0.1 |
| NITROGEN, wppm | 3000–15000 | 200–1500 | 0.001–0.01 |
| CONRADSON CARBON, wt % | 0.1–0.5 | — | — |
| BROMINE NUMBER, cg/g | 4–20 | 0.1–20 | 0.1–3 |
| METALS CONTENT (Ni + V) wppm | 0.01–4 | — | — |
| CETANE NUMBER | — | 30–40 | 30–40 |
| AROMATICS CONTENT wt % | 3–50 | 20–75 | 10–18 |
| Smoke point | — | — | 15–17 |

As shown, the typical reactor feed to the hydrotreating-hydrocracking reactors will have an unacceptably high sulfur content, the Diesel blend will have a cetane number of between about 30 and about 40, which is unacceptable for incorporating into the Diesel pool, and the kerosene blend will have a smoke point between about 15 and about 17, which is unacceptable for incorporating in the jet fuel pool. These fractions are therefore "out of spec" and need to be improved.

Table 4 below sets forth characteristics of a typical unconverted VGO fraction, a typical jet fuel fraction, and a Diesel fraction which are products of the hydrotreating-hydrocracking reactors.

TABLE 4

| Reactor stages | R2/R3 | R2/R3 | R2/R3 |
|---|---|---|---|
| OUTLET | VGO | Diesel | Kerosene |
| API GRAVITY | 19–24 | 30–35 | 33–36 |
| SULFUR, wt % | 0.002–0.02 | 0.0001 | 0.00002 |
| NITROGEN, wppm | 10–20 | 1–10 | 1–2 |
| CONRADSON CARBON, wt % | 0.01–0.05 | — | — |
| BROMINE NUMBER, cg/g | ~0 | ~0 | 0 |
| METALS CONTENT (Ni + V) wppm | ~0 | — | — |
| CETANE NUMBER | — | 45–58 | 48–53 |
| AROMATICS CONTENT wt % | 3–30 | 20–45 | |
| Smoke point | — | — | 22–25 |

The final process product includes VGO which is useful for FCC or lube, Diesel for the Diesel pool, kerosene for jet fuel, and naphtha for reforming units. The fractions advantageously have significantly reduced sulfur content, and the Diesel fractions have cetane number which has been increased substantially thereby making the Diesel fraction acceptable for incorporation into the Diesel pool. The kerosene fraction has smoke point and cetane number which have been increased substantially thereby making the kerosene fraction acceptable for incorporation into the jet fuel pool or the Diesel pool.

In light of the foregoing, it should be appreciated that a process has been provided for advantageously treating vacuum residue, VGO and Diesel and naphtha feed so as to sequentially remove sulfur from all the streams and increase the cetane number of Diesel fractions and smoke point in the kerosene in a process which is efficient in terms of both energy and equipment. The process therefore provides for converting readily available feeds into valuable end products.

Figure 3:
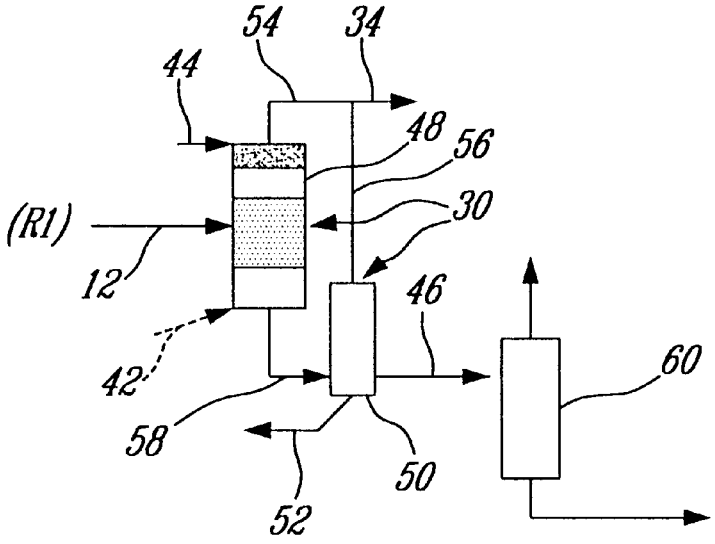
FIG. 3 illustrates stripping and washing steps in accordance with one embodiment of the invention.
Figure 4:
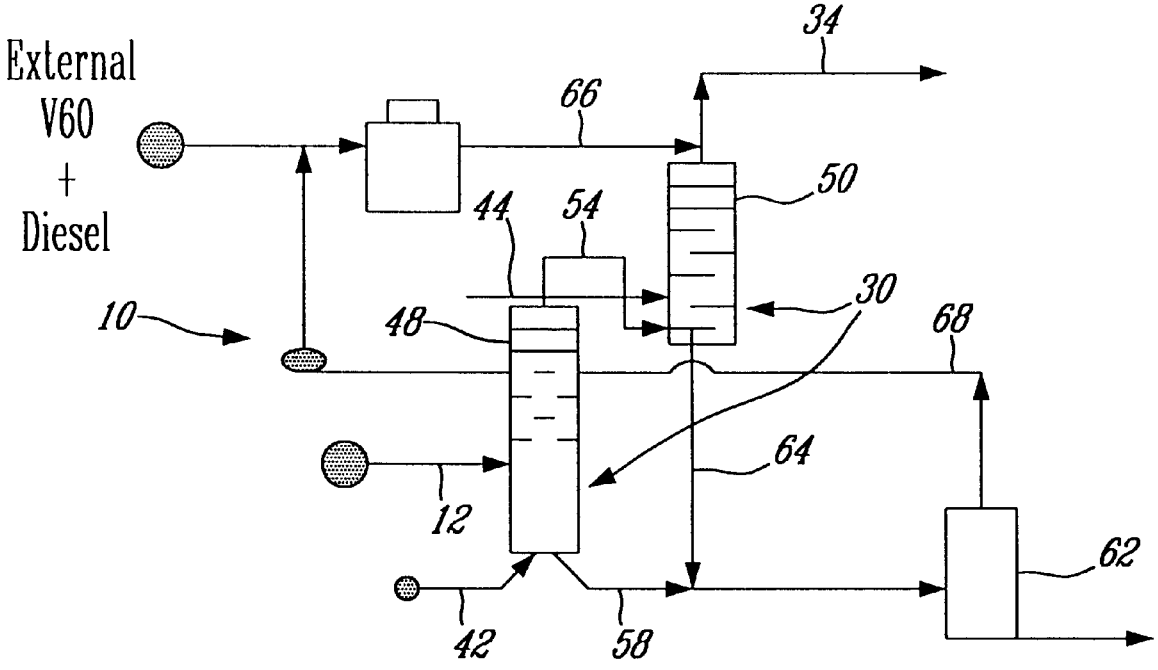
FIG. 4 illustrates stripping and washing steps in accordance with another embodiment of the invention.
Figure 5:
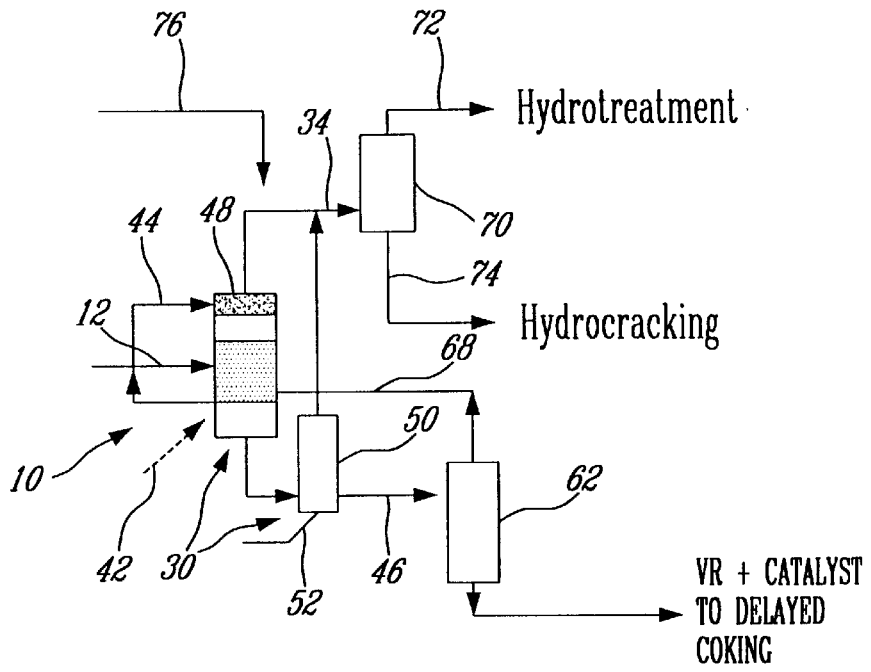
FIG. 5 illustrates still another embodiment of stripping and washing steps of the present invention.

Turning now to FIGS. 3, 4 and 5, several additional embodiments of the stripping and washing (HSSW) zone 10 of the present invention, previously shown in FIG. 1, are described.

FIG. 3 shows a hot separation-stripping-washing unit 30 in accordance with the present invention receiving a reaction feed 12 from a hydrocracking process (R1). The reaction feed includes hydrogen, naphtha, kerosene, Diesel, LVGO, HVGO, vacuum residue, $C_1$–$C_4$ hydrocarbons, hydrogen sulfide, ammonium, catalysts and contaminants. Reaction feed 12 is introduced into unit 30, typically at an intermediate vertical position such that stripping gas 42 can be introduced vertically lower than reaction feed 12, and washing feed 44 is introduced at a vertically higher position than reaction feed 12. Counter-current flow occurs within unit 30, with stripping gas 42 proceeding upwardly through the unit and washing feed 44 flowing downwardly, each performing the desired function so as to assist in producing the desired separated gas phase 34 including hydrogen, naphtha, Diesel, LVGO,HVGO, $C_1$–$C_4$, $H_2S$ and $NH_3$. Also produced is liquid portion or phase 46 containing small amounts of LVGO, HVGO and particularly vacuum residue plus catalyst, that can advantageously be passed as feed to a vacuum distillation column to produce VGO to be recycled, and a vacuum residue and catalyst fraction that can be advantageously fed to a delayed coker unit or the like for further processing.

Still referring to FIG. 3, stripping and washing unit 30 in this embodiment is provided as two units 48, 50, with reaction feed 12 introduced into unit 48. Stripping gas 42 in this embodiment is fed to a lower portion of unit 48, and washing feed 44 is introduced to an upper portion of unit 48. Additional stripping gas 52 is also fed to a lower portion of unit 50, and units 48, 50 each produce a gas phase fraction 54, 56 which is combined to form gas phase 34. Further, liquid 58 exiting upstream unit 48 is introduced to downstream unit 50 and, after further stripping results in liquid phase 46 identified above, suitable as feed to a vacuum distillation column 60 for separating different fractions for further treatment.

FIG. 4 also illustrates another alternative embodiment of HSSW zone 10 according to the invention. As shown, reaction feed 12 is fed to unit 30 which in this embodiment is, like in other embodiments, provided in two units 48, 50.

Washing feed 44 is introduced to unit 50 as shown, and stripping gas 42 in this embodiment is introduced to a lower portion of upstream unit 48. Unit 48 produces a gas phase fraction 54 including the desired components as discussed above that are sent to unit 50 for further separation, and a liquid phase 58 which is fed to vacuum fractionation 62. Unit 50 produces an additional liquid phase 64 which is combined with liquid phase 58 and sent to vacuum fractionation 62, and gas phase 34 for further hydrotreatment-hydrocracking. The downstream reaction could for example be a hydrotreating reaction or a second separator zone plus a hydrotreating reaction, and in such an embodiment, additional naphtha/Diesel may be mixed with gas phase 34 to produce the desired hydrotreating reaction feed. Washing feed 44 can be from external source as shown or may be recycled from vacuum fractionation 62 if desired. FIG. 4 shows recycled VGO 68 being mixed with external VGO, naphtha and/or Diesel to form an additional component of feed to the downstream reactors. Diesel could also be used for this purpose.

FIG. 5 illustrates a further embodiment of the process of the present invention wherein a downstream hot separator 70 is used to further treat gas phase 34 from units 48, 50. Hot separator 70 produces a gas phase 72 which can be fed to a hydrocracking reactor. Gas phase 72 from hot separator 70 would include hydrogen, hydrogen sulfide, ammonia, $C_1$–$C_4$, naphtha, kerosene, Diesel and LVGO. Liquid phase 74 is composed mainly of LVGO and HVGO. Hot separator 70 serves to further enhance the separation of phases while still maintaining the desired temperature and pressure through to the downstream hydrotreatment and hydrocracking reactors. External VGO and/or external Diesel 76 in this embodiment may be useful to mix with gas phase 34 or gas phase 72 in order to control reaction temperature in downstream reactor. External VGO and/or Diesel may also serve as washing feed, either alone or with recycled VGO as shown in FIG. 5.

In accordance with another embodiment of the present invention, the stripping and washing zone and steps as described above can advantageously be used to integrate one or more hydroprocessing stages or reactors into other high-pressure and high-temperature circuits including but not limited to residue hydrocracking circuits and the like, thereby obtaining further benefits from the already established high-pressure and high-temperature conditions and utilizing one sequential treatment without cold separating or conventional hot separating. This is particularly advantageous as compared to conventional systems that treat products of a first reaction to obtain an intermediate product, and then separately treat this intermediate product to obtain final product.

Figure 6:
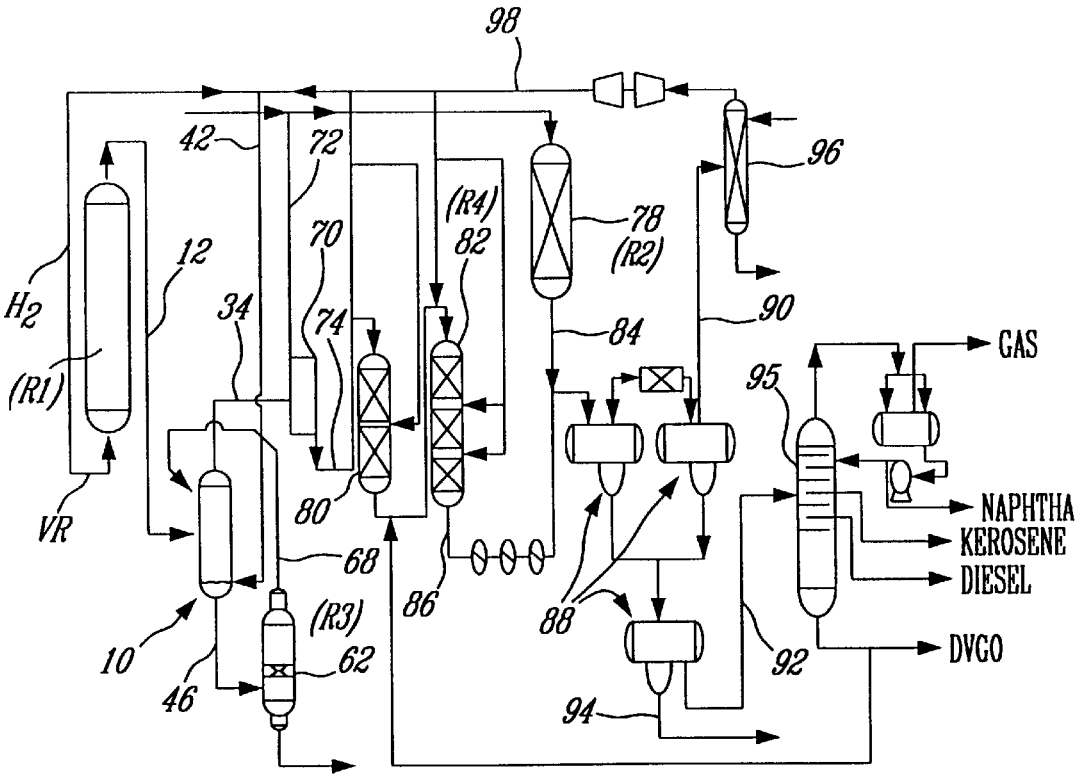
FIG. 6 schematically illustrates the integration of a two stage hot separation washing and stripping in a vacuum residue hydrocracking process in accordance with the present invention.

FIG. 6 illustrates a residue hydrocracking scheme incorporating an HSSW zone 10 similar to the embodiment of FIG. 5. FIG. 6 shows HSSW zone 10, a hot separator 70, a gas phase reactor 78, and hydrotreating and hydrocracking reactors 80, 82.

In this embodiment, a sequential process is established utilizing vacuum residue hydrocracking (R1) followed by hot separation stripping and washing 10, conventional hot separation 70, and gas phase hydrotreatment-hydrocracking reactors 78 (R2), 80 (R3) and 82 (R4), so as to produce desired products. FIG. 6 shows a vacuum residue feed to a VR hydrocracking reactor R1 which produces reaction feed 12 to HSSW zone 10. Liquid phase 46 from zone 10 is fed to fractionator 62 for separating a VGO fraction 68 for recycling as washing feed to zone 10. Hydrogen stripping gas 42 is also fed to zone 10 as shown. Gas phase 34 from zone 10 is fed to hot separator 70 for further treatment at gas phase reactor (GPR) 78 so as to produce an upgraded gas product 84, while a liquid phase 74 from hot separator 70 is fed to reactors 80 (R3) and 82 (R4) for producing an upgraded liquid product 86 which is advantageously combined with gas phase 84 and fed to a series of separators 88 for separating a gas phase 90, a liquid product phase 92 for additional processing, for example in a fractionation or distillation unit 95, and a final liquid phase or bottoms 94. As shown, gas phase 90 may be treated in separator 96 to obtain recycled hydrogen 98 for use as recycled stripping gas and to satisfy any hydrogen needs at reactor R2, R3 and/or R4. Unreacted vacuum gas oil (DVGO) is recycled from unit 95 and may be further treated in reactor 82 (R4) as shown so as to enhance conversion rates to desired products. This scheme is applied in Examples 1 and 2 discussed below.

In accordance with the present invention, and as further illustrated in FIGS. 7–10, a large number of different systems or configurations can be established for the second, third and any additional reactors or hydrotreatment reactor systems for use in treating the gas and liquid phases from HSSW zone 10 in accordance with the present invention.

Figure 7:
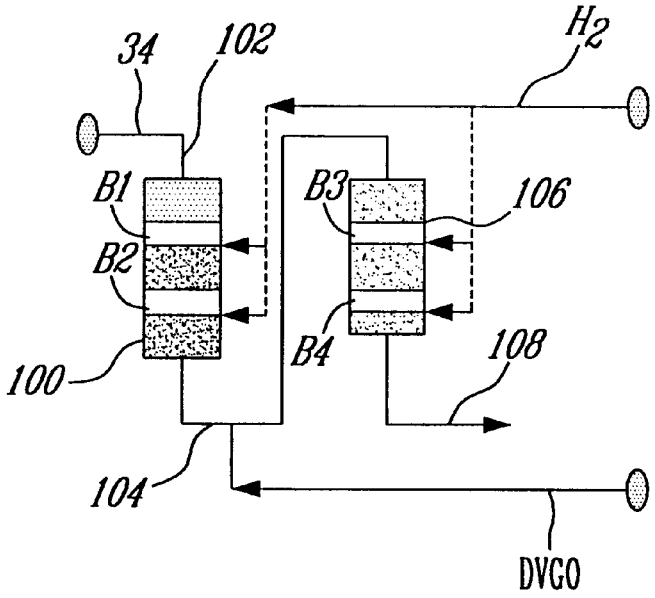
FIG. 7 illustrates an integrated process in accordance with the present invention which is oriented to naphtha production.

FIG. 7 shows an HSSW zone 10 product gas phase 34 which is treated in a manner selected and adapted to accomplish naphtha production from the first vacuum residue hydrocracking product. FIG. 7 shows gas phase and reaction product 34 from hot separation-stripping and washing zone 10 being fed to a first hydrotreatment reactor 100. First hydrotreatment reactor 100 is preferably a trickle bed reactor, and inlet 102 to reactor 100 may advantageously be a liquid-gas contactor inlet adapted to provide for trickle bed operation as desired. Further, first hydrotreatment reactor 100 is provided with catalyst, preferably several different catalysts in different beds, for obtaining a desired end result. The product stream 104 from first hydrotreatment reactor 100 may suitably be fed to a second hydrotreatment reactor 106.

Second hydrotreatment reactor 106 in this embodiment is also preferably provided with several catalyst beds and adapted to provide a final product stream 108 which may advantageously include hydrogen, naphtha, jet fuel, Diesel fuel, and unconverted vacuum gas oil fractions. The catalyst beds for reactors 100 and 106 are labeled B1, B2, B3 and B4, and these beds may advantageously contain the following types of catalysts for maximizing naphtha production: B1—metal trapping and coke resistant catalyst; B2—HDS-HDN-HAD catalysts; B3—KCK catalyst; and B4—deep naphtha desulfurization catalyst. As will be further discussed below, the catalyst beds for such a system can advantageously be selected so as to provide the highest possible conversion of vacuum gas oil to desirable naphtha product as in this embodiment, or to other desirable products.

In the system shown in FIG. 7, the product stream from second hydrotreatment-hydrocracking reactor 106 is advantageously fed to a cold separator (not shown) wherein unconverted gas oil (UCVGO or DVGO) is recycled for further treatment. In the embodiment of FIG. 7, unconverted gas oil is recycled and mixed with the intermediate product stream from first hydrotreatment reactor 100 for further treatment in second hydrotreatment reactor 106, thereby providing for higher total conversion rates of the initial gas oil feed.

In the embodiment of FIG. 7, wherein maximized naphtha production is desired, it may be desirable in accordance with the present invention to provide first hydrotreatment reactor 100 and second hydrotreatment reactor 106 each with two distinct catalyst bed arrangements as disclosed.

It should be appreciated that the catalyst system as illustrated in FIG. 7 and described above is tailored to tolerate some carryover of metallic or asphaltene-type material, and also to desulfurize and hydrogenate distillates so as to provide the desired product. One example of suitable types of catalyst for use in this type of process includes those catalysts described in U.S. Pat. No. 4,520,128, which catalyst is active to help reduce the affects of asphaltene carryover. The second hydrotreatment reactor 106 in this embodiment has also been tailored to be sulfur and nitrogen tolerant and the hydrocracking catalyst for us in first bed B3 may for example be catalyst as described in U.S. Pat. No. 5,558,766.

A system as illustrated in FIG. 7 can be operated to provide for 80% or more conversion (by volume) of the combined vacuum gas oil from the HSSW zone 10 and external VGO, and conversion is primarily to naphtha products. Such a process would consume a large amount of hydrogen, but would also produce an extremely high quality product.

Figure 8:
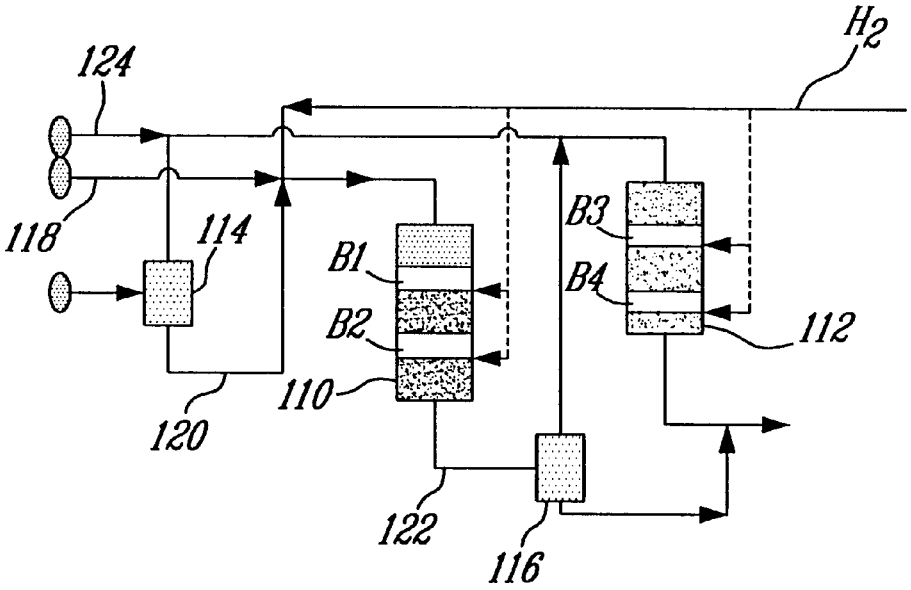
FIG. 8 illustrates an integrated process in accordance with the present invention which is oriented toward production of high quality Diesel.

FIG. 8 illustrates an alternative embodiment of the integrated process scheme of the present invention, wherein first and second hydrotreatment reactors 110, 112 are provided and operate or tailored to obtain a high quality Diesel oil final product. In this case and HSSW zone 10 and two hot separator 114, 116 are used.

In the embodiment of FIG. 8, first reactor 110 has a first catalytic bed B1 and a second catalytic bed B2, and second hydrotreatment reactor 112 also has a first catalytic bed B3 and a second catalytic bed B4. In this embodiment, additional hot separators 114, 116 are provided, each as described in connection with the stripping and washing zones and embodiment of FIG. 5 described above, for further enhancing the desired outcome of this process.

As shown, first reactor 110 accepts as a reaction feed a portion of external VGO 118 and the liquid fraction 120 from hot separator or 114. First reactor 110 produces an intermediate product stream 122 which is advantageously fed to second hot separator 116 as shown.

First and second additional hot separators 114, 116 each also produce a gas phase as described above, and these gas phases are advantageously combined with an external Diesel feed 124 and fed to second hydrotreatment reactor 112. These gas phases, as described above, advantageously contain hydrogen, naphtha, Diesel and LVGO fractions, and hydrogen sulfide and ammonia contaminants. The final product stream from second hydrotreatment reactor 112, along with the liquid phase from second additional hot separation system 116, may suitably then be fed to a fractionation unit and the like for obtaining the desired separate product fractions. Hydrogen obtained from this step may advantageously be recycled to various points in the process as illustrated in FIG. 8.

It should be appreciated that the embodiment of FIG. 8 is dedicated or tailored for the production of high quality Diesel fuel with moderate VGO conversion rates (MHCK). In this scheme, two additional hot separator systems are use, and provide for additional benefits in the first and second hydrotreatment reactor 110, 112.

As with the embodiment of FIG. 7, the catalytic beds provided in first and second hydrotreatment reactors 110, 112 are preferably provided having specific particular functions and catalysts.

First hydrotreatment reactor 110 preferably has first catalytic bed B1 provided with a similar metal trapping and coke resistant catalyst as the embodiment of FIG. 7 described above. Second bed B2 of first hydrotreatment reactor 110 may suitably have a mild hydrocracking catalyst, typically having a 50% VGO conversion rate, and this catalyst is preferably sulfur and nitrogen resistant.

Second hydrotreatment reactor 112 is also preferably provided as described above with first and second catalytic beds B3, B4, and first catalytic bed B3 may advantageously be provided having a catalyst active toward hydrodearomatization as well as sulfur and nitrogen removal, and second catalytic bed B4 may advantageously be a catalyst selected from naphtha hydrodesulfurization. Diesel and naphtha produced in first hydrotreatment reactor 112 are then improved in second hydrotreatment reactor 114 and conversion of VGO for such a process would typically be approximately 50% volume in first hydrotreatment reactor 112, and between about 20 and about 30% volume in second hydrotreatment reactor 114.

Figure 9:
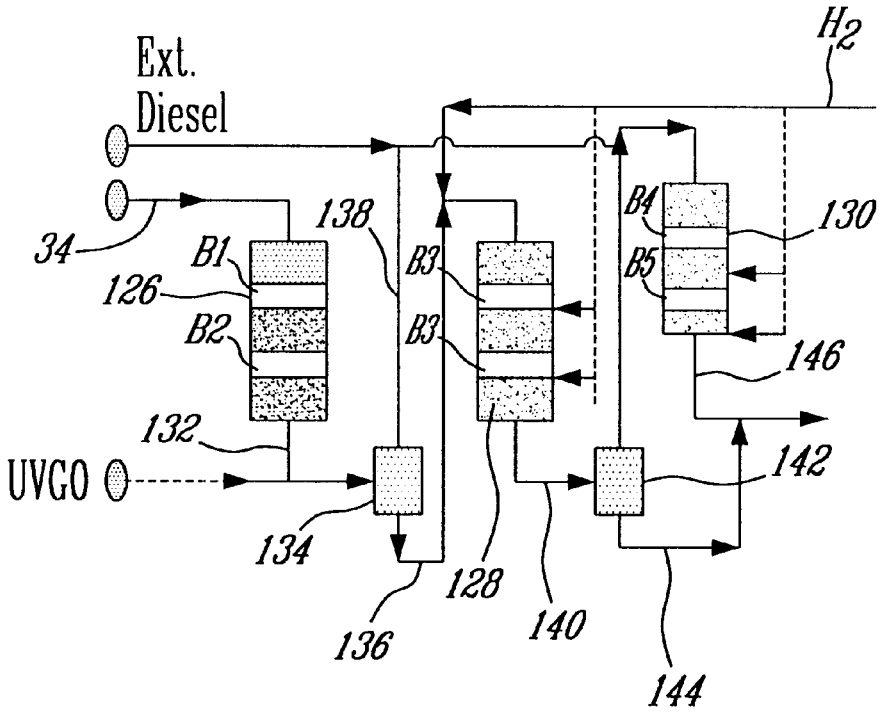
FIG. 9 illustrates an integrated process in accordance with the present invention wherein the system is oriented to hydrocracking for production of jet fuel and Diesel fuel.

Turning now to FIG. 9, still another alternative embodiment of the integrated hydroprocessing scheme of the present invention is illustrated. In this embodiment, three hydrotreatment reactors 126, 128, 130 are provided and tailored to hydrocract for conversion to jet fuel and Diesel fuel fractions.

In this embodiment, the product stream 34 from and HSSW zone 10 as described above is fed to first reactor 126 and results in first intermediate product stream 132. First intermediate product stream 132 may advantageously be mixed with an external or recycled vacuum gas oil feed (VGO), and this mixture can be fed to a hot separation system 134 as described above. Liquid phase 136 from hot separation system 134 can advantageously be fed to second reactor 128, while the gas phase 138 from additional hot separation system 134 can advantageously be mixed with external Diesel and utilized as a portion of feed to third reactor 130. A second intermediate product stream 140 results from second hydrotreatment reactor 128, and this second intermediate product stream may suitably be fed to a second hot separation system 142 where a gas phase is produced and mixed with the gas phase of first additional hot separation system 134 and external Diesel for input to third hydrotreatment reactor 130 as desired.

The liquid phase 144 from second hot separation system 142 may be set aside for feed to a fractionation unit or the like, preferably along with liquid phase product 146 from third reactor 130 as desired.

It should be also noted that hydrogen is obtained from the final product, for example at the fractionation unit, and in this embodiment this hydrogen is preferably recycled as feed to second hydrotreatment reactor 128 as shown.

The scheme as illustrated in FIG. 9 is ideally used for deeply hydrocracking VGO into jet and Diesel fuel, and can provide for excellent results with or without recycling of unconverted VGO. The preferred catalytic beds of reactors 126, 128 and 130 include a metal trapping catalyst B1 followed by a sulfur and nitrogen resistant mild hydrocracking catalyst B2 in first reactor 126, hydrocracking catalyst B3 which can be the same or different in second hydrotreatment reactor 128, and sulfur and nitrogen resistant catalyst for improving Diesel fuel B4 and desulfurizing naphtha B5 can advantageously be provided in the beds of third hydrotreatment reactor 130.

In this embodiment, first and second hydrotreatment reactors 126, 128 both include hydrocracking stages, while the third hydrotreatment reactor 130 is dedicated to hydrofinishing of jet and Diesel fuel.

Figure 10:
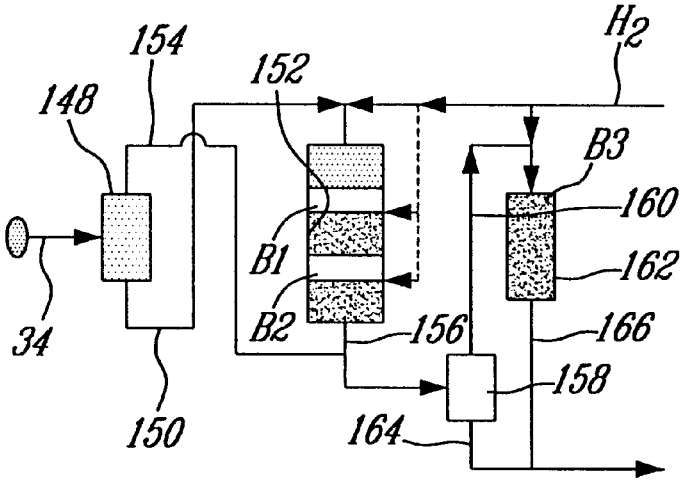
FIG. 10 illustrates a basic configuration of an integrated process in accordance with the present invention for hydrodesulfurization of VGO and mild hydrocracking.

Turning now to FIG. 10, still another alternative embodiment in accordance with the integrated processing scheme of the present invention is illustrated.

In this embodiment, products 34 from HSSW zone 10 are fed to an additional hot separation system 148, wherein a liquid phase 150 is obtained for feeding to a hydrotreatment reactor 152, and a gas phase 154 is separated. The liquid phase fed to reactor 152 can suitably be contacted with recycled hydrogen gas, and the product 156 of reactor 152 is mixed with gas phase 154 from hot separator 148 and sent to an additional hot separation system 158 so as to provide a gas phase 160 composed hydrogen, naphtha, kerosene, Diesel, and light VGO that are treated in a finishing reactor 162. The liquid 164 from second hot separator 158 is mixed with product 166 of reactor 162 and sent to a separation stage to recover medium-high quality products or syncrude as desired.

In accordance with this alternative embodiment, catalysts are selected for obtaining a medium-high quality syncrude production integrating a HSSW system and a mild-hydrocracking reaction system in a vacuum residue high pressure high temperature loop. Specifically, reactor 152 has a first bed B1 of metal trapping coke resistant catalyst, and a second bed B2 of HDS-HDN MHCK catalyst, while reactor 162 has a finishing catalyst B3 such as HDS-HDN (Diesel and naphtha finishing) catalyst. In this process, VGO is also converted into distillates. The resulting product quality is excellent, although somewhat lower than quality obtained utilizing other embodiments of the invention.

The systems as illustrated in FIGS. 6–10 above are various embodiments which advantageously integrate one hydrotreatment-hydrocracking process into residue hydrocracking circuit utilizing the hot separation stripping and washing (HSSW) method of the present invention. These different processes each advantageously provide for savings in economy through utilization of already existing high pressure and high temperature conditions, and through treating various fractions in a single reactor, thereby providing for savings in equipment as well.

It should be readily appreciated that FIGS. 3, 4 and 5 illustrate variations of the stripping and washing steps which are all well within the broad scope of the present invention, and which all advantageously provide for high temperature and high pressure separation of a reaction feed into a gas phase and liquid phase containing the desired components for subsequent processing in one, two or more stages of hydrotreatment-hydrocracking, and that FIGS. 7–10 illustrate variations of sequentially integrated hydrotreatment-hydrocracking stages using the hot separation-stripping and washing systems of FIGS. 1, 3, 4 and/or 5 or variations thereof.

EXAMPLE 1

In order to illustrate the advantageous results obtained in accordance with the present invention, two processes were run. The first process used a vacuum residue hydrocracking reaction zone followed by hot separation-washing, and a sequentially hydrotreat-hydrocrack of the gas phase produced by the HSSW system. Liquid phase from the HSSW system was stored for further use. In this first process, naphtha, Diesel and VGO fractions were produced and then treated in second and third reaction stages to upgrade yields and quality. This scheme was call SEHP1.

The second process used the same vacuum residue hydrocracking stage (R1) (same operating severity). The product was fed to an HSSW system; the liquid product from the bottom of the HSSW system was stored, and the gas phase produced from the top of the HSSW zone was fed to a second separation system at the same pressure and at 40° C. less temperature, as shown in FIG. 5.

Gas phase from the second high pressure hot separation system (HSSW) containing hydrogen, naphtha, Diesel, LVGO, $C_1$–$C_4$ hydrocarbon, $H_2S$ and $NH_3$, was fed to a hydrotreating zone (R2). The pressure of the gas phase was within about 80 psig of the pressure of the residue hydrocracking reactor outlet (R1); the liquid phase from the second hot separation system (bottom) contained small amounts of Diesel, LVGO and HVGO and was blended with recycled hydrogen and fed to a hydrocracking reactor zone (R3) operated within about 80 psig of the pressure of the residue hydrocracking reactor outlet (R1). The products from the hydrotreating reactor and hydrocracking reactor were combined and fed to a fractionation tower. This scheme is called SEHP2.

Table 5 sets forth the results of these two process schemes using the same temperature space velocity and reactor volume, but using one or two stage of high pressure and high temperature separation. In the second case (two high pressure separators) a high purity of hydrogen makes up gas if needed, are recycled to the hydrocracking reactors. Table 5 shows that yield and quality are improved from the yield and quality fed to the HSSW system. Using one or two stages of separation improve the yield and quality of naphtha, kerosene and Diesel.

TABLE 5

| | Without SEHP | With SEHP1 | | with SEPH2 |
|---|---|---|---|---|
| Naphtha yields wt % | 10 | 18 | | 15 |
| Jet Fuel wt % | 5 | 13 | | 12 |
| Jet Fuel smoke point | 16 | 22 | | 24 |
| Diesel yields wt % | 13 | 20 | | 29 |
| Diesel Cetane Number | 44 | 55 | | 58 |
| VGO yields | 56 | 28 | | 24 |
| 650° F.+ Conversion (R2/R3) | 0 | 50 | (+R4) | 56 |
| 950° F.+ Conversion (R1) | 90 | 90 | | 90 |

SEPH1 HSSW (FIG. 2 without External Feedstock)
SEPH2 HSSW+HSS (FIG. 6 without External Feedstock)

As shown, the process conducted with high temperature and high pressure stripping and washing followed by a simple hydrotreating and hydrocracking stage (SEPH1) produced more $C_1$–$C_4$/naphtha and VGO and less kerosene-Diesel products than the scheme with HSSW followed by a hot separation system (SEPH2). In addition the product quality is better in the latter process. These processes in accordance with the present invention produced an increase in smoke point of 6–8 numbers, and produced an increase in cetane of 11–14 number (second and third columns) in comparison to the vacuum residue hydrocracking product without integrating the SEHP technology (first column).

EXAMPLE 2

In order to further illustrate the advantageous results obtained in accordance with the present invention, two modes of application HSSW with hydrotreating and hydrocracking processes were run with the same initial vacuum residue hydrocracking reaction stage, but with different ways of hydrotreating the reaction feedstock and the external feedstock. SEHP3 designates one mode where the gas phase produced in the stripping-washing separation stage is blended with 20% vol. external VGO, 15% vol. external Diesel and 10% vol. naphtha fractions, relative to the VGO Diesel and naphtha leaving the hydrocracking reactor and entering the HSSW system. Then the gas phase is slightly cooled (but at the same pressure) by blending outside feeds, and the blend, is sent to hydrotreating-hydrocracking reactors (R2/R3). In the second process or mode (called SEHP4), the same vacuum residue hydrocracking severity is used in the initial reactor, otherwise the same amount of naphtha, kerosene, Diesel and VGO are sent to the HSSW system as in the previous case (SEHP3) and the same amount of external CGO Diesel and naphtha is added but in different way.

The gas phase produced in the HSSW system is partially cooled by adding 20% vol. external VGO (same pressure) sent to a second high pressure, hot separation system. From there a gas phase is separated from the top and blended with the 15% vol. external Diesel and 10% external naphtha. That gas phase stream, rich in hydrogen, naphtha, kerosene, Diesel and light VGO, is sent to a hydrotreating reactor. The liquid phase obtained from the second hot separation system is blended with recycled hydrogen and sent to hydrotreating-hydrocracking reactors (R2/R3) operating at substantially the same pressure as the previous reactor (R4). In addition, the volume of all the reactors (R2/R3/R4) and the temperature are the same as the previous case (SEHP3). Table 6 sets forth the results of this process, identifying the SEHP3 process with one hydrotreating-hydrocracking stage and "SEHP4" as the two stage hydrotreating-hydrocracking process. Notice that both schemes use the same feedstock and the same operating conditions and the same separation-stripping and washing stages.

TABLE 6

| | Blend* | SEHP3 | SEHP4 |
|---|---|---|---|
| Naphtha sulfur wt ppm | 1000 | 30 | 2 |
| Kerosene smoke point | 16 | 22 | 24 |
| Diesel CI | 41 | 47 | 52 |
| VGO Sulfur wt % | 3.41 | 700 | 400 |
| VGO conversion wt % | 0 | 82 | 87 |
| SEHP3 according to FIG. | 2 | | |
| SEHP4 according to FIG. | 6 | | |

*The blend is produced by mixing the vacuum residue hydrocracking products plus the external VGO, Diesel and naphtha.

Most of the blend properties are better than the products from vacuum residue conversion (R1 outlet). By sequentially integrating the HSSW plus the hydrocracking reactor, the VGO conversion increases and the quality of the unconverted VGO is improved. The same is true for naphtha and Diesel as shown in Table 6.

The process conducted with high pressure stripping and washing and one hydrotreating stage accomplished and important reduction in sulfur content and improved Diesel, cetane number and kerosene smoke point. However, the process carried out utilizing two hydrotreating stages resulted in a greater sulfur reduction and higher cetane number and smoke point. The SEHP4 mode also experienced a greater conversion rate for the VGO fraction.

EXAMPLE 3

Figure 11:
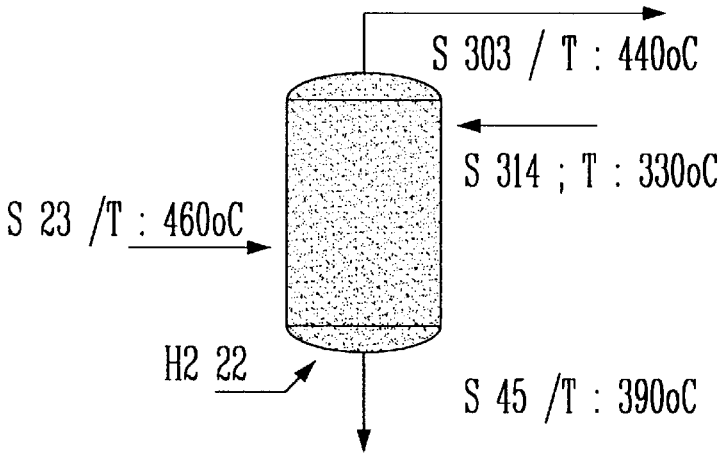
FIG. 11 presents a mass and energy balance example of HSSW in accordance with the invention.

This example illustrates washing and stripping separation (HSSW) in accordance with the present invention. FIG. 11 shows a mass and energy balance of an HSSW zone or vessel according to the invention, showing flowrate S (tons/hour) and temperature for reaction feed, stripping gas, washing feed, gas-phase product and liquid phase product. This shows beneficial separation without cooling, or loss of pressure.

Top and bottom streams were analyzed from this process utilizing 50 ton/hour of hydrogen stripping (approximately 10% wt.) and using 209 ton/hour of washing feed (approximately 15% vol.) and using for comparison a hot separation process with no stripping or washing. Table 7 sets forth the results.

TABLE 7

| | Inlet | Top | Bottom | Top* | Wash Oil |
|---|---|---|---|---|---|
| HS System/Streams | 23 | 303 | 45 | x | |
| $H_2S$ | 193 | 200 | 1 | 160 | 0 |
| $NH_3$ | 26 | 26 | 0 | 14 | 0 |
| $H_2O$ | 46 | 46 | 0 | 34 | 0 |
| C1/C2 | 348 | 378 | 3 | 345 | 0 |
| C3/C4 | 236 | 234 | 2 | 212 | 0 |
| Naphtha C5–200 C. | 884 | 878 | 6 | 856 | 0 |
| Mid Dist 200–350 C. | 1638 | 1686 | 95 | 1334 | 143 |
| VGO 350–500 C. | 1327 | 1131 | 362 | 967 | 166 |
| residue 500 C.+ | 273 | 12 | 261 | 106 | 0 |
| solids | 114 | 0 | 114 | 0.1 | 0 |

Top* is the gas phase using just a hot separation

Table 7 shows hydrogen stripping and washing resulted in more gas phase production. The $H_2S$, ammonia, $C_1$–$C_4$, naphtha and Diesel are stripped from the bottom (liquid) to the top (gas phase), and the vacuum residue and the solid are washed out from the gas phase. The total amount of products leaving the HSSW system include the amount of Diesel and VGO used for washing and the hydrogen employed for stripping. Comparing the column "Top" and "Top*", the difference is highlighted as between the HSSW system of the present invention and conventional hot separator. The results prove that the process of the present invention HSSW reduces the vacuum residue and catalyst carryover into the gas phase, and reduces the $H_2S$, ammonia, $C_1$–$C_4$ and the naphtha going into the bottom or liquid phase to the vacuum fractionation tower. This reduces the cost of the latter. The Diesel and VGO are advantageously fractionated in the vacuum tower and partially pumped back to the stripping zone in the HSSW system in a closed loop.

EXAMPLE 4

Figure 12:
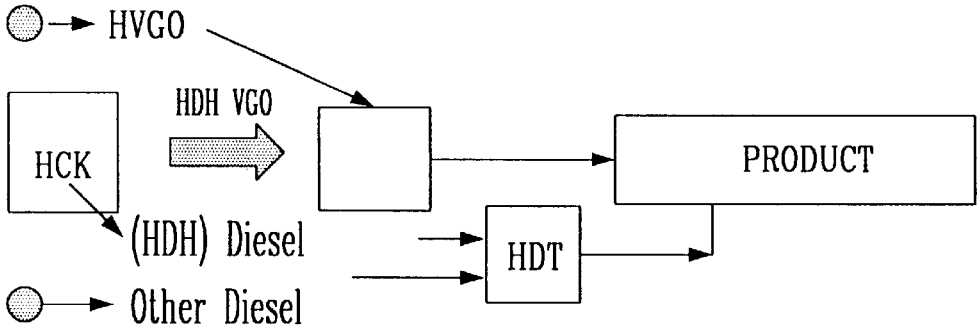
FIGS. 12 and 13 comparatively illustrate a separate conventional process (FIG. 12) and an integrated process in accordance with the present invention (FIG. 13).

This example demonstrates the difference between separate or stand-alone processes and the integrated processes of the present invention. A conventional scheme was established, and is illustrated in FIG. 12, wherein a first vacuum-residue hydrocracking, with distillation step, is carried out to obtain VGO which, along with external VGO, is treated in a stand alone hydrocracking process (reactors and all other units). Diesel from the initial vacuum residue hydrocracking step is mixed with other Diesel for hydrotreatment. The properties of products from the initial hydrocracking stages for this scheme are illustrated in Table 8 below under the heading "Scheme II".

TABLE 8

| | Scheme I | Scheme II |
|---|---|---|
| Feed Components, BPD | | |
| Naphtha from VRHCK | 15,142 | 0 |
| Middle Distillates from VRHCK | 23,476 | 0 |
| VGO from VRHCK | 17,864 | 17,864 |
| Straight run HVGO | 40,940 | 40,940 |
| Total Feed Throughput | 97,422 | 58,804 |
| Fuel properties | | |
| API Gravity | 23.9 | 14.3 |
| Sulfur, wt % | 2.12 | 2.78 |
| Nitrogen, ppm | 4060 | 3542 |
| Conradson Carbon, wt % | 0.25 | 0.56 |
| Metals (Ni + V), ppm | 1.5 | 3.6 |
| TBP Distillation, C. | | |
| 10 vol. % | 157 | 375 |
| 30 vol. % | 286 | 436 |
| 50 vol. % | 389 | 478 |
| 70 vol. % | 445 | 519 |
| 90 vol. % | 516 | 604 |
| Total Pressure $R_1$ Inlet, psig | 2,800 | 2,400 |
| $H_2$ Pressure $R_1$ Inlet, psig | 2,050 | 2,200 |
| Total Recycle Gas Rate, scfb | 15,030 | 20,000 |
| LHSV HDT Reactors, v/v/h | 0.9 | 0.9 |
| LHSV HCK Reactors, v/v/h | 0.33 | 0.98 |
| Cycle Length, months | 24 | 24 |

Figure 13:
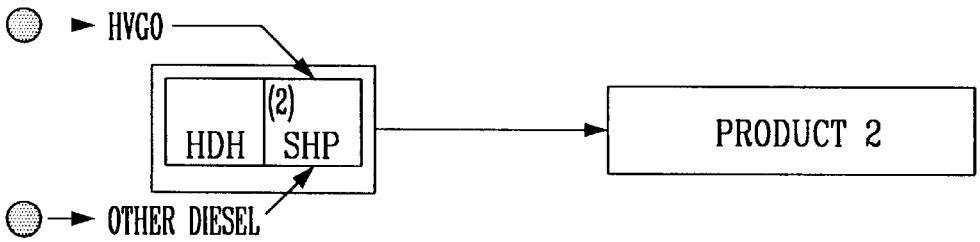

A scheme was also established for comparing the process of the present invention to the conventional process. In this scheme, schematically illustrated in FIG. 13, all the product from vacuum residue hydrocracking plus external Diesel and VGO (same amount as in Scheme II), is sent to an HSSW system, and then the gas phase is sent to hydrotreating-hydrocracking reactors (just the reactors and nothing else) to be processed. The combined product stream from the sequentially integrated process that includes distillation steps is also set forth in Table 8 above under the heading "Scheme I".

The Scheme II process treats all naphtha and Diesel separately from the hydrocracking process, while the Scheme I process treats all distillates in a single integrated reactor system (with a single investment in equipment). Table 9 below sets forth final results in terms of conversion, and Table 10 below sets forth final results in terms of product quality.

TABLE 9

| | SHP Scheme I | Scheme II |
|---|---|---|
| Performance | | |
| VGO Conversion, vol. % | 86.7 | 97 |
| Hydrogen Consumption, scfb | 2177 | 2350 |
| C5+ Liquid Yield, vol. % | 109.7 | 114.8 |
| Product Yields (based on Feed), wt. % | | |
| Hydrogen Consumption | 3.62 | 3.66 |
| $H_2S$ | 2.25 | 2.96 |
| $NH_3$ | 0.49 | 0.44 |
| $H_2O$ | 0.46 | 0 |
| $C_1$–$C_2$ | 0.61 | 0.72 |
| $C_3$–$C_4$ | 2.64 | 3.97 |
| Light Naphtha | 5.49 | 6.86 |
| Heavy Naphtha | 16.46 | 17.21 |
| Jet Fuel | 38.54 | 38.3 |
| Diesel | 28.68 | 30.03 |
| VGO | 8.02 | 2.7 |

TABLE 10

| | SHP Scheme I | HCK Scheme II |
|---|---|---|
| Light Naphtha (C5-85° C.) | | |
| API Gravity | 81.5 | 80.5 |
| Sulfur, ppm | 0.5 | 0.5 |
| Nitrogen, ppm | 1 | 1 |
| Octane Number, $RON_c$ | 78 | 78 |
| P/N/A, vol. % | 84/14/2 | 83/14/3 |
| Heavy Naphtha (85-150° C.) | | |
| API Gravity | 52.2 | 57.8 |
| Sulfur, ppm | 0.5 | 0.5 |
| Nitrogen, ppm | 1 | 1 |
| Octane Number, $RON_c$ | 60 | 61 |
| P/N/A, vol. % | 40/54/6 | 43/49/8 |
| Jet Fuel (150–265° C.) | | |
| API Gravity | 42.5 | 42.8 |
| Sulfur, ppm | 5 | 2 |
| Nitrogen, ppm | 1 | 1 |
| Aromatics, vol. % | 25–21 | 27–23 |
| Flash Point, F | 115 | 120 |
| Freeze Point, F | −63 | −60 |
| Diesel (265–350° C.) | | |
| API Gravity | 37.7 | 35 |
| Sulfur, ppm | 10 | 5 |
| Nitrogen, ppm | 1 | 1 |
| Cetane Number | 58 | 50 |
| Cetane Index | 58 | 53 |
| VGO (350 C.+) | | |
| API Gravity | 26 | 26.6 |
| Sulfur, ppm | 20 | 10 |
| Nitrogen, ppm | 5 | 5 |
| UOP K | 12.8 | 12.6 |

Table 9 shows that the use of a stand alone hydrocracking unit results in a higher conversion (Scheme II 97% VGO conversion) than in the integrated system (Scheme I:86.7% VGO conversion). This is due to conversion in Scheme I process of all the product, and the results are limited by the maximum commercial vessel size available. Scheme I also provides a higher conversion to gasoline, while Scheme II provides a higher conversion to kerosene Diesel. Hydrogen consumption is greater in the stand-alone system of Scheme II.

From Table 10, it should readily be appreciated that both products have outstanding qualities. Of course, the product obtained utilizing Scheme I in accordance with the present invention is obtained along with a cost savings due to efficient utilization of high pressure and temperature conditions and further through less equipment costs.

Light naphtha properties for Scheme I and Scheme II were almost identical. In most cases, this naphtha product could be blended directly into the low octane pool. If additional octane is required, the light naphtha stream is an excellent feed to isomerization processes. Sulfur and nitrogen contents of the heavy naphtha fractions are very low in both schemes, and the naphthalene plus aromatics content is almost 60%, making these streams excellent feedstocks for naphtha reformers and the like.

The kerosene streams, Diesel streams and VGO streams from both schemes also have very desirable properties. Of course, as set forth above, the process of the present invention provides for substantial savings in operating cost and equipment investment cost as compared to the non-integrated Scheme II process.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. An integrated process for treating a vacuum gas oil, kerosene, naphtha and Diesel-containing feed, comprising the steps of:

providing a reaction feed containing residue, vacuum gas oil, kerosene, naphtha, Diesel, hydrogen sulfide, ammonia, and $C_1$–$C_4$ gas phase compounds;

providing a stripping gas;

providing a washing feed; and feeding said reaction feed, said stripping gas and said washing feed to a stripping and washing zone so as to obtain a gas phase containing said hydrogen sulfide, said ammonia, said $C_1$–$C_4$ gas phase compounds, said naphtha, said kerosene, said Diesel and said vacuum gas oil and a liquid phase, wherein said reaction feed is provided at a reaction feed pressure of between about 700 psig and about 3500 psig, and wherein said stripping and washing zone is operated at a pressure within about 80 psig of said reaction feed pressure.

2. The process according to claim 1, wherein said reaction feed comprises hydrogen, hydrogen sulfide, naphtha, kerosene, Diesel, light vacuum gas oil, heavy vacuum gas oil, and $C_1$–$C_4$ hydrocarbons, vacuum residue and catalyst and wherein said liquid phase includes said vacuum residue and said catalyst.

3. The process according to claim 1, wherein said stripping gas is hydrogen gas.

4. The process according to claim 1, wherein said washing feed is selected from the group consisting of Diesel, light vacuum gas oil and mixtures thereof.

5. The process according to claim 4, wherein said washing feed is obtained from an external source.

6. The process according to claim 4, wherein said washing feed comprises a Diesel fraction and a light vacuum gas oil fraction.

7. The process according to claim 1, wherein said gas phase is provided at a pressure within about 80 psig of said reaction feed pressure.

8. The process according to claim 1, wherein said reaction feed is a product of a vacuum residue hydrocracking reaction, and wherein said gas phase is provided as a feed to a hydrotreating-hydrocracking reaction zone.

9. The process according to claim 8, wherein said gas phase is blended with an external naphtha and Diesel fraction at substantially the same pressure as said gas phase to provide a combined phase, and wherein said combined phase is provided as feed to said hydrotreating-hydrocracking reaction zone.

10. The process according to claim 9, wherein said reaction feed contains vacuum residue and catalyst from said vacuum residue hydrocracking reaction, and further comprising feeding said liquid phase to a vacuum distillation unit to recover a Diesel and gas oil fraction that is recycled as said washing feed, and a vacuum residue fraction containing said catalyst.

11. The process according to claim 10, further comprising feeding said vacuum residue fraction to a delayed coking process.

12. The process according to claim 9, further comprising maintaining said gas phase and said combined phase at a pressure within about 50 psig of said reaction feed pressure from said stripping and washing zone to said hydrotreating-hydrocracking reaction zone, whereby compressors are not required between said stripping and washing zone and said hydrotreating-hydrocracking reaction zone.

13. The process according to claim 1, wherein said reaction feed is provided at a reaction feed temperature, and further comprising the steps of providing at least one of said stripping gas and said washing feed at a temperature different from said reaction feed temperature, and mixing said reaction feed, said striping gas and said washing feed in proportions selected to provide a desired resulting temperature.

14. The process according to claim 1, wherein said stripping gas is mixed with said reaction feed at a ratio of said stripping gas to said reaction feed of between about 10 and about 100 $ft^3$ of gas per barrel of feed.

15. The process according to claim 1, wherein said washing feed is mixed with said reaction feed in an amount between about 5% v/v and about 15% v/v with respect to volume of said reaction feed.

16. The process according to claim 1, wherein said stripping and washing zone comprises a reactor having an inlet for said reaction feed, wherein said stripping gas is fed to said reactor below said inlet, and wherein said washing feed is fed to said reactor above said inlet.

17. The process according to claim 1, wherein said reaction feed is obtained from a vacuum residue hydrocracking process, and wherein said gas phase is fed to a hydroprocessing-hydrocracking reactor system.

18. The process according to claim 17, wherein said hydroprocessing-hydrocracking reactor system comprises at least one reactor selected from the group consisting of hydrocracking reactors, hydrotreating reactors and combinations thereof.

19. The process according to claim 17, wherein said hydroprocessing-hydrotreating reactor system comprises a hydrocracking reactor system.

20. The process according to claim 17, wherein said hydrocracking reactor system comprises a first reactor and a second reactor, and further comprising the steps of feeding said gas phase to said first reactor so as to obtain an intermediate product stream, and feeding said intermediate product stream to said second reactor to produce a final product stream comprising hydrogen, naphtha, jet fuel, Diesel and remaining vacuum gas oil.

21. The process according to claim 20, further comprising the step of recycling said remaining vacuum gas oil to at least one of said first reactor and said second reactor.

22. The process according to claim 20, further comprising the step of recycling said hydrogen to at least one of said first reactor and said second reactor.

23. The process according to claim 20, further comprising the steps of defining an additional stripping and washing zone between said first reactor and said second reactor, feeding said intermediate product stream, an additional stripping gas and an additional washing feed to said additional stripping and washing zone so as to obtain an intermediate gas phase and an intermediate liquid phase, and feeding said intermediate gas phase to said second reactor.

24. The process according to claim 17, wherein said hydroprocessing-hydrocracking reactor system is a trickle bed reactor.

25. The process according to claim 17, further comprising feeding said gas phase to said hydroprocessing-hydrocracking reactor system comprises a plurality of catalyst zones arranged serially to be exposed to said gas phase, and wherein an initial one of said plurality of zones has a metal trapping catalyst for removing metal carried by said gas phase into said hydroprocessing-hydrocracking reactor system.

26. A process for upgrading a vacuum residue feed, comprising:

mixing said vacuum residue feed with a vacuum residue hydrocracking catalyst so as to provide a VR reaction feedstock;

subjecting said VR reaction feedstock to hydrocracking conditions so as to produce a VR product containing vacuum gas oil, kerosene, naphtha, Diesel, hydrogen sulfide, ammonia, $C_1$–$C_4$ gas phase compounds, vacuum residue and said catalyst at a VR pressure;

providing a stripping gas;

providing a washing feed;

feeding said VR product, said stripping gas and said washing feed to a stripping and washing zone so as to obtain a gas phase containing said hydrogen sulfide, said ammonia, said $C_1$–$C_4$ gas phase compounds, said naphtha, said kerosene, said Diesel and said vacuum gas oil, and a liquid phase containing said vacuum residue and said catalyst, said gas phase being at a gas phase pressure within about 80 psig of said VR pressure;

feeding said gas phase at said gas phase pressure to a further hydrotreating-hydrocracking zone so as to produce a product stream having upgraded kerosene, naphtha and Diesel fractions; and feeding said vacuum residue and said catalyst to a vacuum residue upgrading process.

27. The process according to claim 26, wherein said gas phase is substantially free of said catalyst and said vacuum residue, and wherein said further hydrotreating-hydrocracking zone comprises a trickle bed reactor.

* * * * *